US006378591B1

(12) United States Patent
McCoy

(10) Patent No.: US 6,378,591 B1
(45) Date of Patent: Apr. 30, 2002

(54) ARCHED SUPPORT ASSEMBLY FOR FABRIC AWNING SYSTEMS

(75) Inventor: Timothy A. McCoy, Winthrop, MA (US)

(73) Assignee: Sunsetter Products Limited Partnership, Malden, MA (US)

( * ) Notice: Subject to any disclaimer, the term of this patent is extended or adjusted under 35 U.S.C. 154(b) by 0 days.

(21) Appl. No.: 09/698,296

(22) Filed: Oct. 27, 2000

Related U.S. Application Data

(60) Provisional application No. 60/171,951, filed on Dec. 23, 1999.

(51) Int. Cl.[7] ..... E04F 10/06

(52) U.S. Cl. ..... 160/67; 160/46; 160/66; 160/72; 135/88.11

(58) Field of Search ..... 160/22, 46, 65, 160/66, 67, 71, 72, 78, 80; 135/89, 88.11, 88.12; 248/354.5

(56) References Cited

U.S. PATENT DOCUMENTS

| | | | | | |
|---|---|---|---|---|---|
| 4,171,013 | A | | 10/1979 | Clark | 160/22 |
| 4,198,998 | A | * | 4/1980 | Duffy | 135/5 AT |
| 4,269,210 | A | * | 5/1981 | Marks | 135/1 R |
| 4,417,597 | A | | 11/1983 | Montgomery | 135/102 |
| 4,508,126 | A | * | 4/1985 | Everard | 135/89 |
| 4,640,332 | A | | 2/1987 | Turner | 160/46 |
| 4,801,119 | A | | 1/1989 | Pelletier | 248/354.5 |
| 4,819,680 | A | | 4/1989 | Beavers | 135/104 |
| 4,862,940 | A | * | 9/1989 | Atchison | 160/67 |
| 5,094,285 | A | | 3/1992 | Murray | 160/67 |
| 5,148,848 | A | * | 9/1992 | Murray et al. | 160/67 |
| 5,203,393 | A | | 4/1993 | Blevins et al. | 160/67 |
| 5,449,032 | A | | 9/1995 | Blevins et al. | 160/80 |
| 5,697,417 | A | | 12/1997 | Spoon | 160/71 |
| 5,752,556 | A | | 5/1998 | Steadman | 160/78 |
| 6,006,810 | A | | 12/1999 | Malott | 160/67 |
| 6,021,835 | A | * | 2/2000 | Malott | 160/67 |
| 6,098,693 | A | * | 8/2000 | Frey, Jr. | 160/67 |
| 6,131,638 | A | * | 10/2000 | Levin | 160/71 |

* cited by examiner

*Primary Examiner*—Bruce A. Lev
(74) *Attorney, Agent, or Firm*—Weingarten, Schurgin, Gagnebin & Lebovici LLP

(57) ABSTRACT

An arched support assembly provides bracing of a fabric awning system and arching of the fabric awning to prevent water collection and increase headroom beneath the awning. The assembly includes an elongated arch member and a brace member that also includes a compressive element, such as a gas spring, to place the assembly under compression. To install the assembly, the arch member is seated at the wall beneath the awning and the brace member is mounted to a support structure of the awning system. The arch member and brace member are engaged at a pivotable point and are raised upwardly until the brace member and the arch member are under compression in a collinear disposition at the pivotable point. The brace member and the arch member are then fixed together

20 Claims, 3 Drawing Sheets

FIG. 1
PRIOR ART
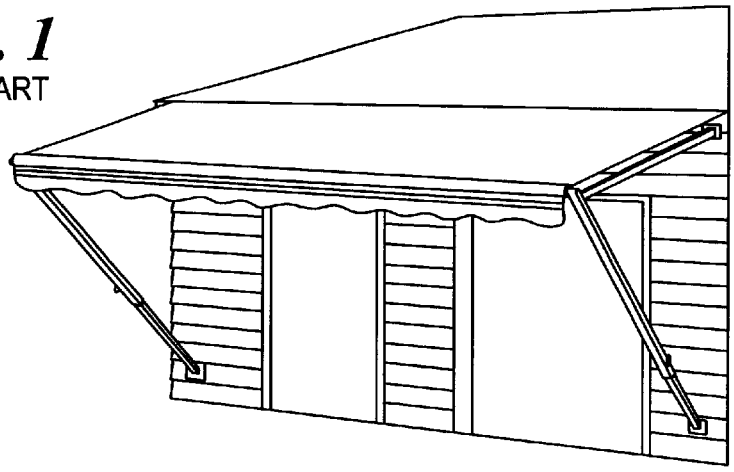
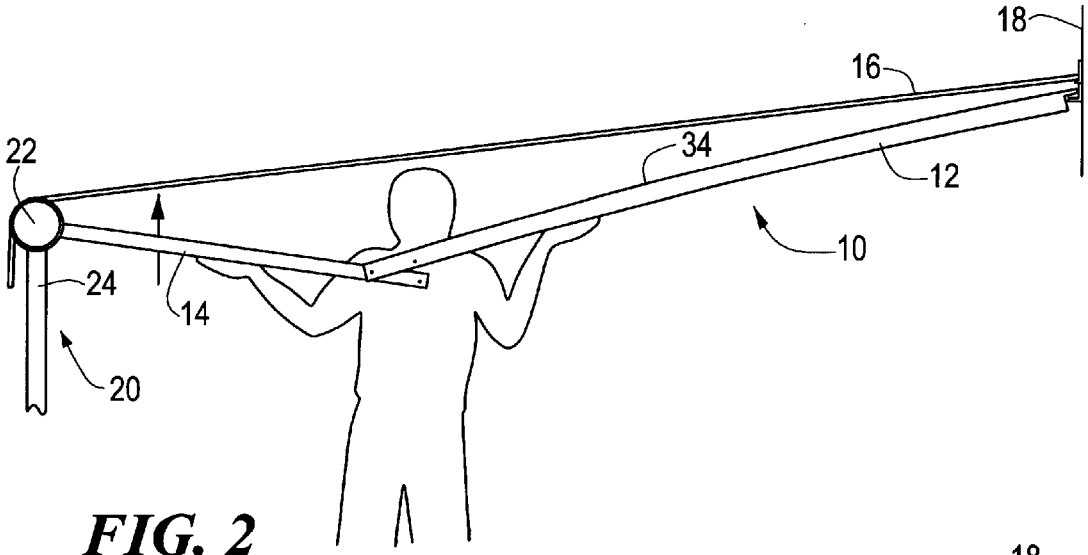
FIG. 2
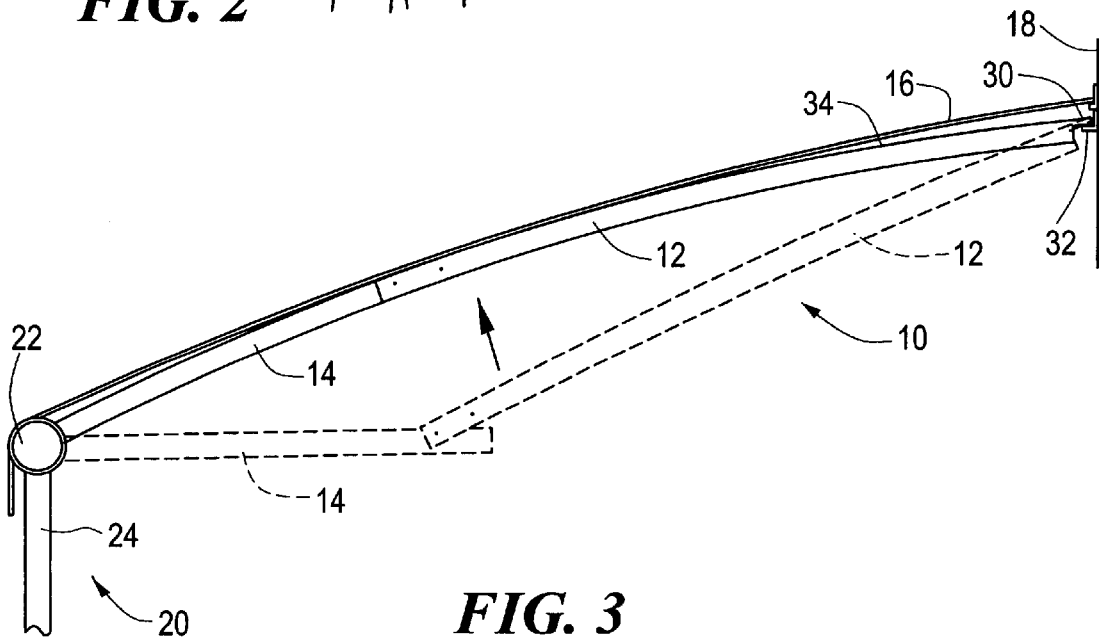
FIG. 3

ARCHED SUPPORT ASSEMBLY FOR FABRIC AWNING SYSTEMS

CROSS REFERENCE TO RELATED APPLICATIONS:

Priority is claimed under 35 U.S.C. § 119(e) of U.S. Provisional Application No. 60/171,951 filed Dec. 23, 1999, the disclosure of which is incorporated by reference herein.

STATEMENT REGARDING FEDERALLY SPONSORED RESEARCH OR DEVELOPMENT

N/A

BACKGROUND OF THE INVENTION

Fabric awnings are used on the outside of structures, such as houses or recreational vehicles, to provide shade and protection from rain. Often the awnings are retractable, such that they may be unfurled or extended when their protection is desired and furled or retracted when they are not needed.

A typical retractable fabric awning system is mounted to an exterior wall of the structure by affixing one edge of the awning fabric to a rail that is fastened to the wall. An opposite edge of the awning fabric is affixed to a roller mechanism or roller bar. The fabric is wound up on the roller mechanism to furl or retract the awning and is unwound from the roller mechanism to unfurl or extend the awning. When in the unfurled position, suitable support arms are provided to hold the roller mechanism spaced from the ground and the wall, with the awning fabric stretched taut under tension between the roller mechanism and the wall. The support arms may be vertical arms that are mounted on the ground or angled arms that are mounted to the exterior wall, as in FIG. 1. The support arms may also be rotatable and/or extensible to move with the awning fabric as it is furled or unfurled.

SUMMARY OF THE INVENTION

The p resent invention provides an arched support assembly for a fabric awning that provides bracing of the awning support structure and arching of the fabric awning. Arching of the fabric awning prevents water collection on the awning by directing water off the edges of the awning and increases headroom beneath the awning.

More particularly, the arched support assembly comprises an elongated arch member and a brace member engageable with the arch member. The arch member extends in a curved configuration from a first end to a second end. The first end is configured to mount to a support structure, such as a support surface or wall, below the fabric awning with a convex side of the arch member facing upwardly toward the fabric awning. The brace member includes a mounting mechanism at an opposite end cooperative with a fitting on another support structure, such as a support bar or a roller mechanism of the awning system. The brace member also includes a compressive element operative to place the assembly under compression between the wall and the roller mechanism.

To install the assembly, the arch member is seated at the wail beneath the awning, and the brace member is mounted to the roller mechanism. The arch member and the brace member are engaged at a first pivot point and are raised upwardly until the brace member and the arch member are under compression in a collinear disposition, bowing the awning upwardly. The brace member and the arch member are then fixed together.

DESCRIPTION OF THE DRAWINGS

The invention will be more fully understood from the following detailed description taken in conjunction with the accompanying drawings in which:

FIG. 1 is a schematic illustration of a prior art fabric awning system;

FIG. 2 is a side view of the arched support assembly of the present invention during installation beneath a fabric awning system;

FIG. 3 is a side view of the arched support assembly installed beneath a fabric awning system;

DETAILED DESCRIPTION OF THE INVENTION

Figure 4:
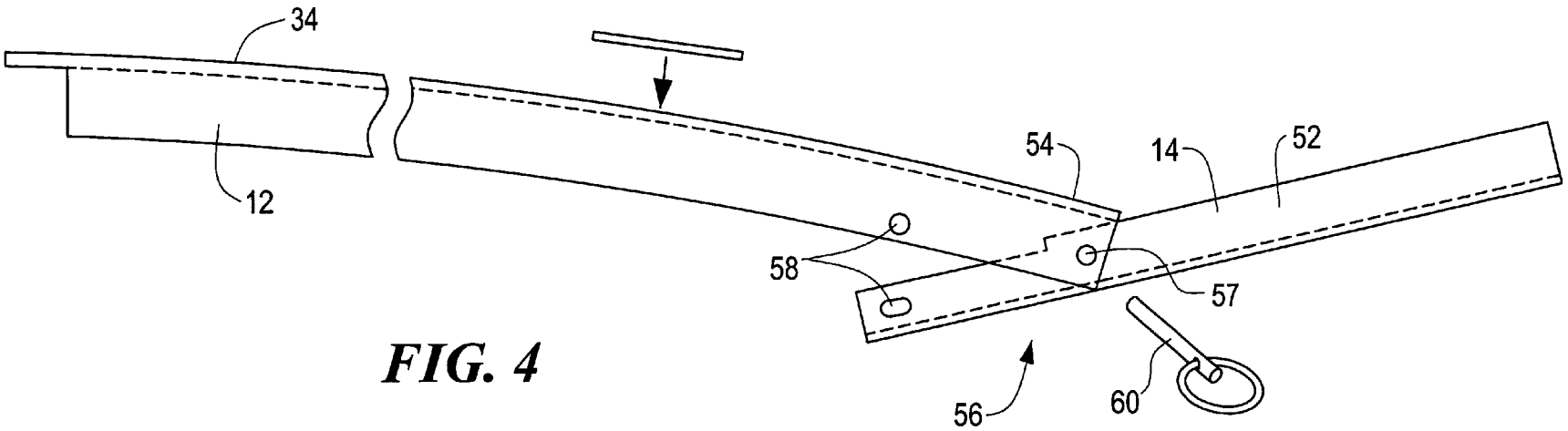
FIG. 4 is a broken view of an arch member and brace member of the present arched support assembly.

Referring to FIGS. 2 and 3, the arched support assembly 10 of the present invention includes an arch member 12 and a brace member 14. The arch member is an elongated, channel shaped member, of for example, extruded aluminum, having a bowed or arched shape along its length. See also FIG. 4. An awning 16 is mounted to a first support structure 18, such as a supporting surface or wall of a house or recreational vehicle, and in the unfurled position, extends under tension to a second support structure 20, such as a support bar or a roller mechanism 22 supported by support arms 24. The arch member 12 and the brace member 14 extend below the unfurled awning from a position on the wall 18 below the awning 16 to the roller mechanism 22. The arch member 12 and the brace member 14 are cooperatively adjustable to place the arch member under compression between the wall 18 and the roller mechanism 22 in an upwardly arched position beneath the fabric awning 16, thereby bowing the fabric awning upwardly.

Figure 5:
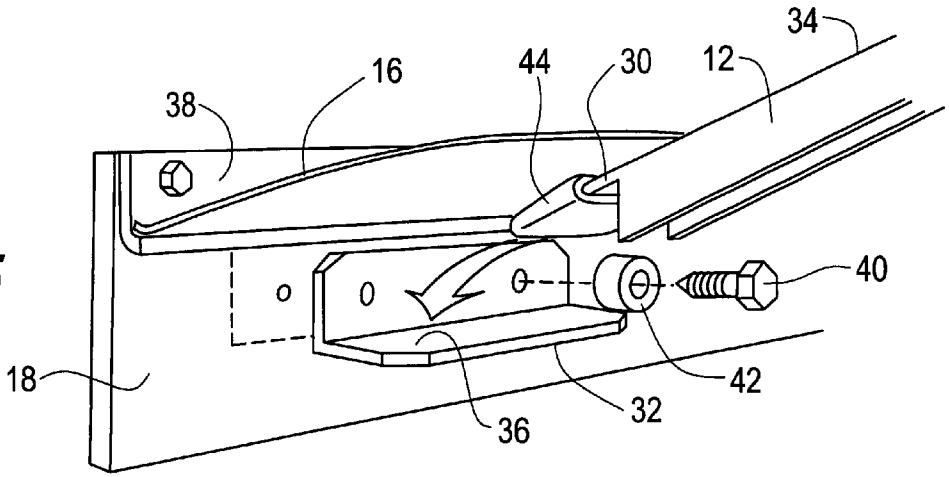
FIG. 5 is a partial view of an end of the arch member.

More particularly, referring to FIG. 5, one end 30 of the arch member 12 rests removably on a seating fixture 32 mounted on the wall 18 or other supporting surface with its convex side 34 facing upwardly toward the fabric awning 16. In a preferred embodiment, the seating fixture is a flange 36 mounted below the rail 38 to which the fabric awning 16 is attached. The flange 36 may be mounted with, for example, two screws 40 and nylon spacers 42 (only one shown). The end 30 of the arch member 12 rests on the flange 36 between the spacers 42, thereby allowing some movement of the arch member, discussed further below. The end 30 of the arch member 12 preferably includes a rubber tip 44 to provide increased friction between the end and the flange and to cover any sharp edges of the end to minimize injury to personnel installing or removing the arched support assembly. It will be appreciated that other seating fixtures or mounting mechanisms may be provided, as would be apparent to those of skill in the art.

Figure 6:
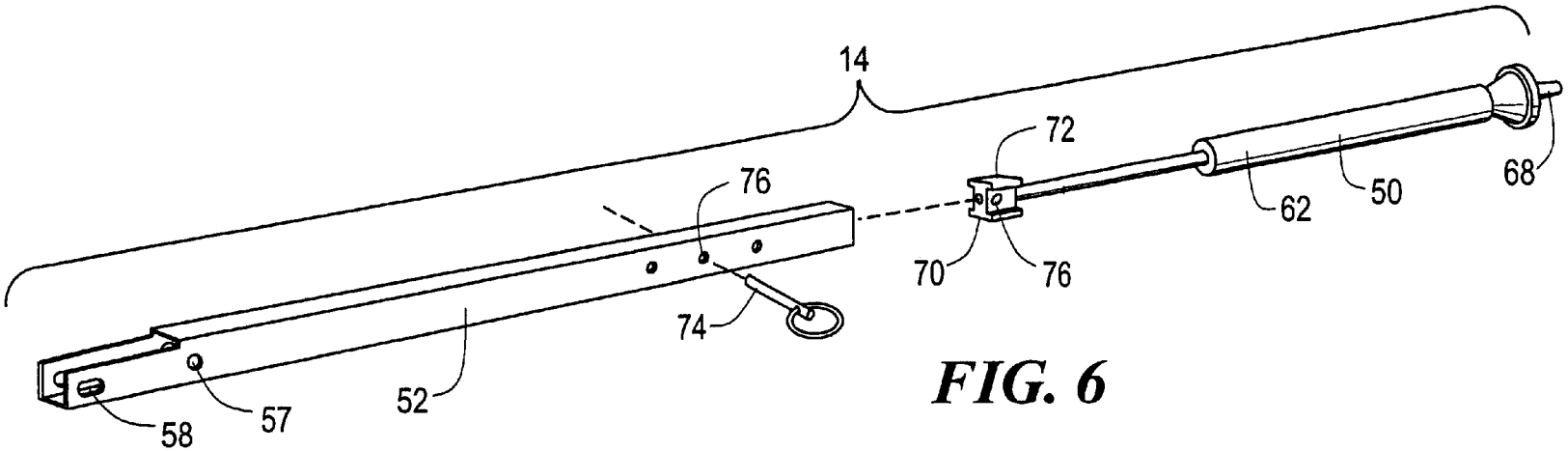
FIG. 6 is an exploded view of the brace member.

The brace member 14 preferably includes a compressive element 50 and a channel-shaped strut 52, best seen in FIG. 6. The compressive element 50 attaches to the roller mechanism 22 of the awning system to place the arched support assembly under compression, described further below. The channel-shaped strut 52 engages with the arch member 12 at one end 54 by an engagement mechanism 56 that allows the arch member and the brace member to be raised as an assembly into position beneath the awning and then to be fixed in the raised position. For example, pairs of aligned openings 57, 58 are provided on the arch member 12 and the strut 52. In a lowered position with the end 30 of the arch member 12 resting on the seating fixture 32 and the compressive element 50 attached to the roller mechanism 22, a first hitch or latch pin 60 is fitted through the first set of openings 57. See FIGS. 3 and 4. The inserted hitch pin allows pivoting motion between the strut 52 and the arch member 12 about a pivotable point defined by the hitch pin. The arch member 12 and the brace member 14 are then raised into a collinear disposition at the pivotable point with the strut 52 resting within the channel of the arch member. A second hitch or latch pin is placed through the second set of openings 58 to fix the arch member 12 and the brace member 14 in position relative to each other. One of the openings in the second set, for example, on the strut, is preferably slot-shaped to provide a wider tolerance for the fit between the strut and the arch member. In this manner, the arch member is placed under compression between the wall and the roller mechanism to bow the fabric awning upwardly.

Figure 7:
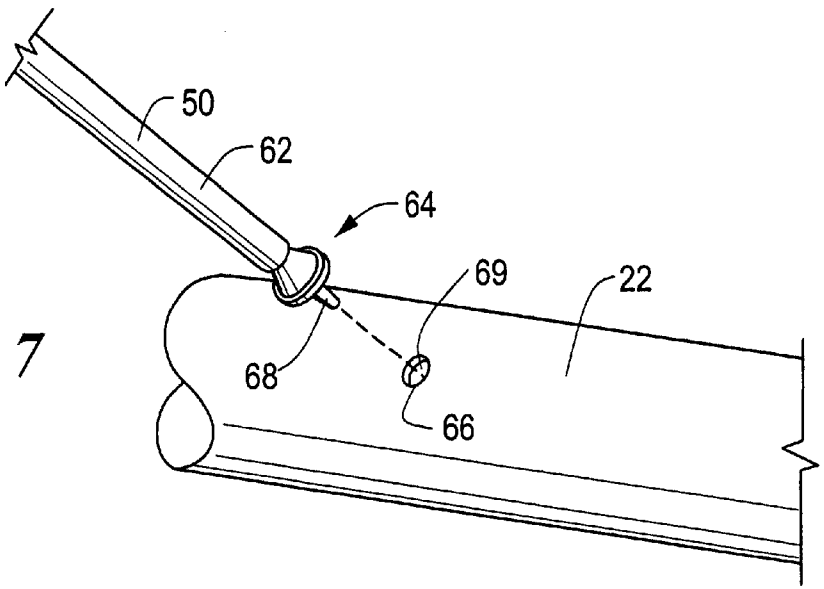
FIG. 7 is a partial view of an end of the compressive element of the brace member.

The compressive element 50 of the brace member 14 preferably comprises a gas spring 62 or shock absorber having a piston and cylinder that exert a compressive force against opposing bodies. Referring to FIG. 7, the gas spring is removably fixed by a suitable mounting mechanism 64 at one end to a cooperative fitting 66 on the support structure of the awning system, such as the roller mechanism 22. For example, the gas spring may include a pin 68 at one end that fits within a cooperative opening 69 on the roller mechanism. Other mounting mechanisms may be provided, as will be appreciated by those of skill in the art. For example, the gas spring may have a pad at the end cooperatively curved to abut against the surface of the roller mechanism.

The other end of the gas spring is provided with an end fitting 70 that is fixed to the strut 52. See FIG. 6. For example, the end fitting may comprise a block 72 that fits within the channel of the strut 52 and is fixed thereto by a hitch or latch pin 74 that fits through cooperative aligned openings 76 in the block and the strut. A number of openings may be provided in the strut to allow the length of the arched support assembly to be adjusted to accommodate different sizes of awnings or to account for variations in awning length due to manufacturing tolerances, different height positions of the awning, or any other reason.

The use of a gas spring in the brace member is preferred to facilitate compression during installation and to compensate for movements of the awning due to wind. The gas spring may include a visual indicator, if desired, to denote the correct compressive force. A compressive force of 50 lbs. per arched support assembly is typically suitable for most awning systems. Alternatively, the correct position of the gas spring may be provided by measurement to a predetermined standard. For example, a spacing between the end of the strut and the roller mechanism that is between 1¾ inches and 2¾ inches has been found to be suitable for most awning systems using gas springs of 50 lbs. Other types of compressive elements, such as a torsion spring, may be used, as will be appreciated by those of skill in the art.

As noted above, in the raised position, the upper surface 34 of the arch member 12 is in engagement with the underside of the fabric awning 16. The arch member is arched or bowed to provide a bow to the fabric such that any water collecting on the fabric such as from rain will run off and not collect or pool on the fabric. The bow also provides more headroom beneath the awning. A hook component from a hook-and-loop type fastener may be placed, such as with adhesive, on the upper surface of the arch member so that the hooks engage the awning fabric, which helps to minimize shifting of the awning fabric with respect to the arched support assembly. The arched support assembly also provides strengthening to the support structure of the awning system.

A plurality of arched support assemblies 10 may be provided in spaced arrangement across the width of an awning, depending on the awning size. For example, a single, centrally located arched support assembly is suitable for an awning that is about seven feet wide. For awnings of about nine feet in width, two arched support assemblies are preferably provided located symmetrically about the center. Five arched support assemblies are preferably provided for a twenty-foot wide awning.

In the preferred embodiment, the arched support assembly 10 is readily installable and removable to accommodate awning systems that may be frequently furled and unfurled, such as patio and recreational vehicle awnings.

The arched support assembly is also useful for other awning structures in which additional bracing and/or arching of the fabric may be desired. It will be appreciated that the arched support assembly may be permanently affixed beneath an awning structure if desired. Also, the arched support assembly may be reversed such that the arch member 12 is supported by the second support structure 20 and the brace member 14 is supported by the first support structure 18.

The invention is not to be limited by what has been particularly shown and described, except as indicated by the appended claims.

What is claimed is:

1. An arched support assembly for a fabric awning system, the fabric awning system including a fabric awning attached along one edge to a first support structure and along an opposite edge to a second support structure and extending under tension between the first support structure and the second support structure, the arched support assembly comprising:

an elongated arch member extending in a curved configuration from a first end to a second end, the first end configured to mount to the first support structure below the fabric awning with a convex side of the arch member faceable upwardly toward the fabric awning; and a brace member engageable with the arch member in a co-linear disposition adjacent the second end by an engagement mechanism and including a mounting mechanism at an opposite end configured to mount to the second support structure, the brace member including a compressive element operative to place the arch member under compression between the first support structure and the second support structure, the engagement mechanism including an element comprising a pivot point disposed to provide pivoting between the brace member and the arch member about an axis orthogonal to the co-linear disposition of the brace member and the arch member.

2. The assembly of claim 1, wherein the brace member and the arch member are engageable in a co-linear disposition adjacent the second end of the arch member.

3. The assembly of claim 1, wherein the brace member and the arch member include at least two sets of aligned openings; and further comprising at least two pins insertable through the two sets of aligned openings when in alignment to fasten the brace member and the arch member together.

4. The assembly of claim 1, wherein the brace member is adjustable along its length.

5. The assembly of claim 1, wherein the mounting mechanism at the opposite end of the brace member comprises a pin that fits within a cooperative opening on the second support structure.

6. The assembly of claim 5, wherein the mounting mechanism at the opposite end of the brace member comprises a pin formed on an end of the compressive element that fits within a cooperative opening on the second support structure.

7. The assembly of claim 1, wherein the mounting mechanism at the opposite end of the brace member comprises a pad that abuts against the second support structure.

8. The assembly of claim 1, wherein the compressive element comprises a gas spring or a shock absorber or a torsion spring.

9. The assembly of claim 1, wherein the brace member further comprises a strut that is fixedly secured to the compressive element and that is engageable with the arch member to transfer compressive forces between the compressive element and the arch member.

10. The assembly of claim 9, wherein the strut is formed as having a channel.

11. The assembly of claim 1, wherein the arch member is formed as having a channel.

12. The assembly of claim 1, wherein the arch member is an extruded aluminum member.

13. The assembly of claim 1, further comprising a hook fastener component attached to the convex side of the arch member for engagement with an underside of the fabric awning.

14. The assembly of claim 1, further comprising a seating fixture mountable to the first support structure below the one edge of the fabric awning and configured to support the first end of the arch member at the first support structure.

15. The assembly of claim 14, wherein the seating fixture comprises a flange mountable to the first support structure.

16. The assembly of claim 14, further comprising a rubber tip on the first end of the arch member.

17. The assembly of claim 1, wherein the first end is configured to mount to a vertical support surface and the mounting mechanism is configured to mount to a roller mechanism.

18. The assembly of claim 1, wherein the first end is configured to mount to a roller mechanism and the mounting mechanism is configured to mount to a vertical support surface.

19. A fabric awning system comprising:

a fabric awning attached along one edge to a vertical support surface and along an opposite edge to a support bar and extending under tension between the vertical support surface and the support bar; and an arched support assembly disposable beneath the fabric awning to provide an upward arch to the fabric awning, comprising:

an elongated arch member extending in a curved configuration from a first end to a second end, the first end configured to mount to the vertical support surface below the one edge of the fabric awning with a convex side of the arch member facing upwardly toward the fabric awning, and a brace member engageable with the arch member was added after "arch member" adjacent the second end by an engagement mechanism and including a mounting mechanism at an opposite end cooperative with a fitting on the support bar, the brace member including a compressive element operative to place the arch member under compression between the vertical support surface and the support bar, the engagement mechanism including an element comprising a pivot point disposed to provide pivoting between the brace member and the arch member about an axis orthogonal to the co-linear disposition of the brace member and the arch member.

20. A method for providing an arch to a fabric awning system, the fabric awning system comprising a fabric awning attached along one edge to a vertical support surface and along an opposite edge to a support bar and extending under tension between the vertical support surface and the support bar, the method comprising:

providing an arched support assembly beneath the fabric awning, the assembly comprising:

an elongated arch member extending in a curved configuration from a first end to a second end, and a brace member engageable. with the arch member adjacent the second end and including a compressive element operative to place the arch member under compression between the vertical support surface and the support bar;

seating the first end of the arch member on a seating fixture mounted to one of the vertical support surface and the support bar beneath the fabric awning;

mounting the brace member to a fitting on the other of the vertical support surface or the support bar;

engaging the brace member to the arch member with an engagement mechanism comprising a pivotable point;

raising the brace member and the arch member upwardly until the brace member and the arch member are in a collinear disposition at the pivotable point orthogonal to an axis of the pivotable point and under compression between the support bar and the vertical support surface and the arch member places a bow in the fabric awning; and fixing the brace member and the arch member together in the collinear disposition.

* * * * *

UNITED STATES PATENT AND TRADEMARK OFFICE

CERTIFICATE OF CORRECTION

PATENT NO. : 6,378,591 B1 
DATED : April 30, 2002
INVENTOR(S) : Timothy A. McCoy It is certified that error appears in the above-identified patent and that said Letters Patent is hereby corrected as shown below:

Column 1,
Line 46, “p resent” should read -- present --;
Line 61, “wail” should read -- wall --;

Column 6,
Lines 7-8, “was added after “arch member”” should read -- in a co-linear disposition --.

Signed and Sealed this

Fourth Day of March, 2003

JAMES E. ROGAN
*Director of the United States Patent and Trademark Office*